United States Patent [19]

Dick et al.

[11] Patent Number: 4,596,366

[45] Date of Patent: Jun. 24, 1986

[54] TEXTILE BOBBIN

[75] Inventors: H. Wayne Dick; John B. Shoemaker, both of Lexington, N.C.

[73] Assignee: PPG Industries, Inc., Pittsburgh, Pa.

[21] Appl. No.: 701,718

[22] Filed: Feb. 14, 1985

[51] Int. Cl.[4] ..... B65H 75/10; B65H 75/26

[52] U.S. Cl. ..... 242/118.3

[58] Field of Search ..... 242/118, 118.3, 118.31, 242/118.32; 264/80

[56] References Cited

U.S. PATENT DOCUMENTS

| | | | |
|---|---|---|---|
| 2,273,373 | 2/1942 | Perry | 242/118.32 |
| 2,535,188 | 12/1950 | Beckner | 242/118.32 |
| 3,165,564 | 1/1965 | Howle et al. | 264/80 |
| 3,532,291 | 10/1970 | Newman | 242/118.31 |
| 3,860,194 | 1/1975 | Roscher | 242/118.32 |
| 4,390,144 | 6/1983 | Mueller | 242/118.3 |
| 4,519,557 | 5/1985 | Newman | 242/118.31 |

*Primary Examiner*—John M. Jillions

*Attorney, Agent, or Firm*—John E. Curley

[57] ABSTRACT

A textile bobbin for winding glass fiber strand is shown which contains a mottled surface over part or all of its surface and has a slightly raised, generally equally spaced ribs on its surface between the bobbin flange and the top. In one embodiment, the bobbin is mottled on its surface between the ribs and axial grooves are provided on the surface from the upper rib to the bobbin top.

13 Claims, 2 Drawing Figures

TEXTILE BOBBIN

The present invention relates to bobbins, more particularly the present invention relates to a textile bobbin useful for winding strand thereon and still more particularly, the present invention relates to a textile bobbin having particular utility in winding textile fiber glass strands thereon.

BACKGROUND OF THE INVENTION

Textile bobbins have been used in the past to wind fiber glass and other type strand materials thereon. Bobbins have also been employed which utilize on the winding surface of the bobbin ribs in order to assure proper securing of the strands to be wound on the bobbin surface. A typical bobbin of the type contemplated by the instant invention is the bobbin described in U.S. Pat. No. 3,860,194 issued by Applicants' assignee. Bobbins of the type described in the aforementioned U.S. patent have found substantial utility in the packaging and shipping of fiber glass yarns. Improvements are constantly sought to insure good adherence of the yarns or strands to the surface of the bobbin during winding, storage and shipping. As the fiber glass yarns become finer, i.e., smaller in diameter and the package weights on bobbins increases, it is especially important that the bobbins be constructed so that as little slippage as possible of the wound yarn on the surface of the body of the bobbin occurs after it is wound thereon. In accordance with the instant invention, a bobbin is provided which is an improvement over bobbins of the type disclosed in the aforementioned U.S. patent. Further, the bobbin of the instant invention is constructed to provide firm adherence of glass fibers to its surface to reduce yarn slippage.

SUMMARY OF THE INVENTION

In accordance with the instant invention, a bobbin is provided which has a body, generally cylindrical in configuration and containing a flange at one end of the body. The flange is typically a flat circular surface adapted to support yarn wound on the body of the bobbin. The surface of the bobbin body is roughened over all of a substantial portion of its length, i.e., greater than 50 percent of its length. The bobbin also contains on its surface a plurality of circular ribs spaced equidistant from each other and occupying usually at least 50 percent of the length of the bobbin body from the bottom to the top. The upper portion of the bobbin body may be roughened or smooth on its surface. In the preferred embodiment, rather than a smooth surface, a plurality of microgrooves are provided beginning on the surface of the body above the last ribs, i.e, the rib closest to the top and extending to the bobbin top. The bobbin body is normally provided with a top member which has a shoulder and neck portion similar to the configuration shown in U.S. Pat. No. 3,860,194 to permit nesting of the bobbins one upon the other during shipment. The interior of the body of the bobbin of course like the bobbin of the prior art patent is generally hollow with only internal supporting ribs being provided for wall rigidity.

BRIEF DESCRIPTION OF THE DRAWINGS

Reference is made to the accompanying drawings in which.

DETAILED DESCRIPTION OF THE INVENTION

Turning to the drawings and FIGS. 1 and 2 in particular, the bobbin embodiments embraced by Applicants' invention will now be described in detail.

Figure 1:
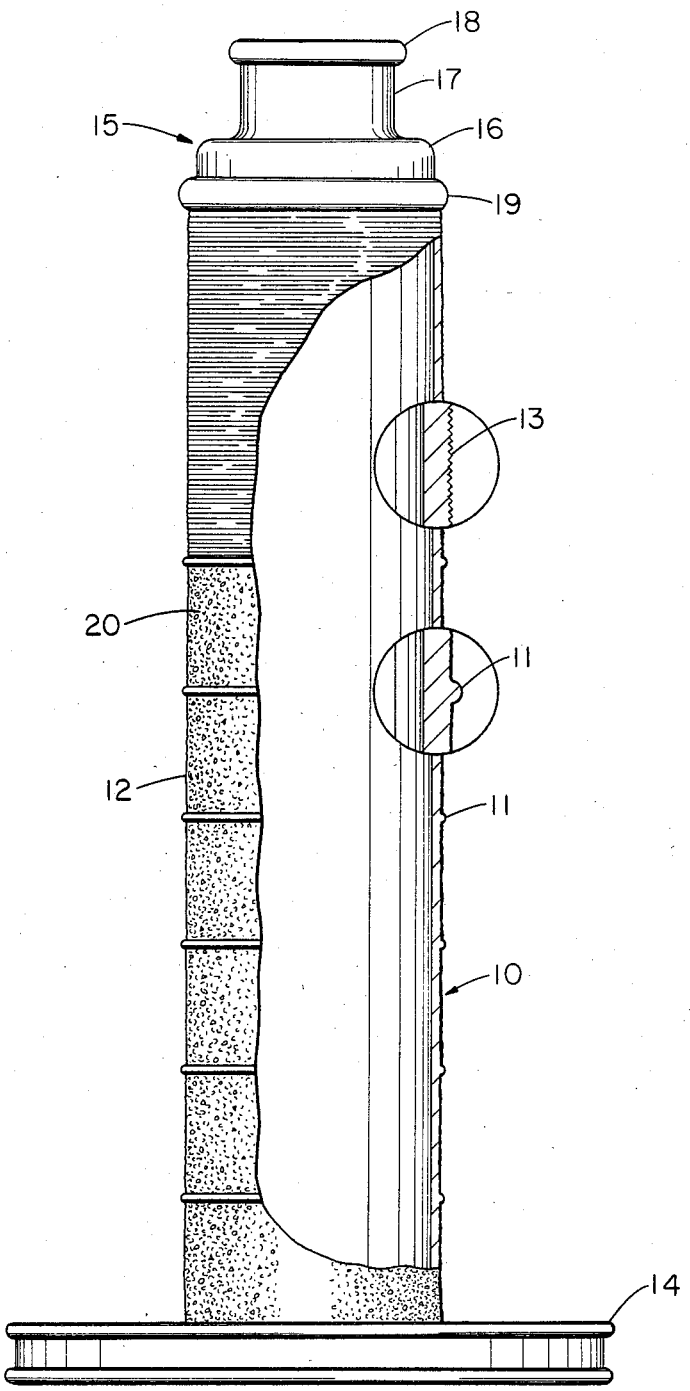
FIG. 1 is a side elevation view of the bobbin of the instant invention with partially enlarged cross-sections showing the positioning of the ribs and microgrooves on the bobbin body.

In the bobbin of FIG. 1, there is shown a bobbin generally indicated as 10 which is comprised of a body 12. The body 12 terminates at one end at a circular flange member 14 and its other end at a cover or top member generally indicated 15. Body 12 is provided with a plurality of ribs 11, six being shown in the drawing, which project from the surface of the body 12 and encircle it. A plurality of microgrooves 13 are shown cut into the surface of the body 12 above the uppermost rib and extending to the base 19 of the top member 15. The surface of the body between the flange 14 and the ribs is provided with a roughened exterior formed by randomly sized and dispersed ridges 20.

Top member 15 is provided with a base 19 which connects it to the body 12 and shoulder 16 with a neck 17 rising from the shoulder and terminating in a circular collar 18. In the preferred embodiment of the bobbin of FIG. 1, the ribs 11 are spaced equidistant from each other. The lowermost rib is spaced from the flange 14 the same distance that each rib is spaced from adjacent ribs. Some variation in the spacing of the ribs from each other and the flange from the first rib is possible but preferably the spacing is uniform. Similarly it is preferred that the grooves 13 be of equal depth and equally spaced, one from the other. While some variation may be tolerated, it is not preferred.

Figure 2:
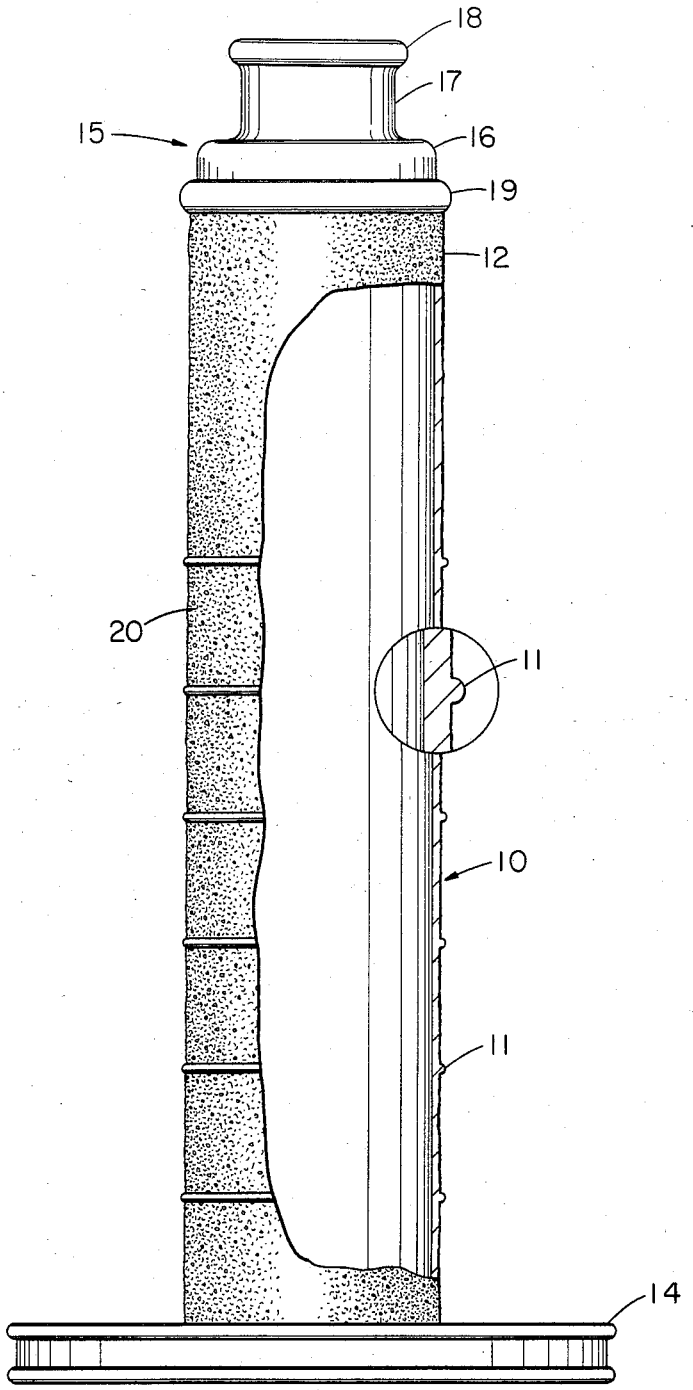
FIG. 2 is a side elevation view with a partially enlarged section view of one rib on the bobbin surface and showing the roughened surface on an entire body.

Turning to FIG. 2, the bobbin, generally indicated 10, is comprised of a body 12, terminating at one end in a flange 14 and at the other end at the base 19 of a top member generally indicated as 15. The body 12 is provided with a plurality of ribs 11, which extend outwardly from the body, are spaced from each other and encircle the body. The ribs 11 are spaced along the body from the flange 14 to a point preferably above the midpoint but at least to the midpoint of the body. The surface of the body 12 between the flange 14 and the base member 19 of top 15 is roughened with randomly sized and dispersed ridges 20 provided thereon. The top member 15 is comprised of a base 19 attached to the body 12 from which shoulder 16, neck 17 and collar 18 extend. In the preferred embodiment of FIG. 2, the ribs 11 are spaced from each other at equal distances. The lowermost rib is spaced that same distance from flange 14. While some variation from equal distance can be tolerated, it is not preferred.

DESCRIPTION OF THE PREFERRED EMBODIMENT

The bobbin of FIG. 1 is comprised of a hollow cylindrical body 12, flange 14 and top 15 having a total length of about 13.5 inches from the base of the flange 14 to the upper edge of collar 18. The cylindrical body 12 of the bobbin 10 is approximately $11 \pm 0.15$ inches in length. The ribs 11 are spaced 1.25 inches apart, 6 being shown in the drawing. The lowest rib is spaced 1.25 inches from the surface of the flange 14. The surface of the bobbin between the ribs as shown in FIG. 1 is mottled and roughened in appearance with ridges 20 to provide a rough surface on which the yarn may be carried during winding and which assists in preventing yarn slippage as the yarn builds on the bobbin. That portion of the bobbin beyond the upper rib is generally smooth and contains grooves 13 cut into its surface to promote yarn adherence and prevent slippage of yarn on the bobbin surface. The ribs 11 shown on the body 12 of the bobbin 10 as shown in FIG. 1 have a radius of 0.015 inch. The upper rib on the body 12 is 7.5 inches from the upper surface of the bobbin flange 14. The upper 3½ inches of the bobbin surface is smooth and grooved. The bobbin top 15 has a rounded base 19, 0.375 inch in height, a shoulder 16 rising above it which is 0.375 inch in height, a neck 17 which is approximately 0.75 inch in height and terminates in a collar 18 about 0.3 inch in height.

The base 19 is cylindrical and 2.75 inches in diameter, shoulder 16 is also cylindrical and 2.36 inches in diameter, neck 17 which is also cylindrical has a diameter of 1.58 inches. The outer diameter of cylindrical collar 18 is 1.8 inches. The overall height of the top member 15 from its attachment to the body 12 to the top of the collar 18 is about 1.8 inches and permits the bobbin top 15 to be nested into the bottom flange 14 of a similar bobbin for stacking during shipment. The grooves 13 are cut to a depth of at least 0.001 inch, generally between 0.001 and 0.005 inch, preferably 0.001 to 0.003 inch, and the grooves are spaced one from the other from the upper rib to the base 19 of top 15 at intervals of at least 0.001, generally between 0.001 and 0.005 inch and preferably between 0.002 and 0.003 inch.

The bobbin of FIG. 2 is comprised of a hollow, cylindrical body 12, flange 14 and top 15 having a total length from the base of flange 14 to the upper edge of collar 18 of 13.5 inches. The body 12 is 11 inches in length and six ribs 11 are spaced along the length of the body 12 at 1.25 inch intervals from the upper surface of flange 14 to a point on the body 7.5 inches from the upper surface of flange 14. Ribs 11 are curved with a radius of 0.015 inch. The entire surface of the body 12 is roughened and mottled with randomly sized and distributed ridges 20 thereon. The top member 15 is constructed in the same manner as the hereinbefore described top of the bobbin of FIG. 1 with the base 19, shoulder 16, neck 17 and collar 18 having the same dimensions as those used in the bobbin of FIG. 1.

The bobbin of the instant invention may be constructed of any suitable material. In general, the bobbins utilized are typically formed from polystyrene or other similar polymeric materials that permit mass production in injection molding apparatus. Utilization of other materials, however, can be made without departing from the spirit of the instant invention.

The bobbin construction herein described of spaced ribbing coupled with the roughened surfaces employed and/or the closely spaced microgrooves on the upper surfaces of the body provide the art with a bobbin that resists yarn slippage when the bobbins are loaded with yarn and are then subjected to heat treatment of the yarn contained on them and/or subsequent handling and shipping.

Although the present invention has been described with reference to certain specific embodiments, it is not intended that such embodiments and details be regarded as limitations upon the scope of the invention except insofar as appears in the accompanying claims.

We claim:

1. A textile bobbin comprising a body defined by a flange at one end and a top member at the other end, a plurality of spaced ribs on said body spaced from each other and the flange at fixed distances, the rib closest to the said top member being at least at the midpoint of said body between the flange and the top, a plurality of grooves in the surface of said body between the top member and the rib closest to the top member, said grooves being uniformly spaced from each other from the top member to said rib closest to the top member, and a plurality of ridges of irregular shape and random distribution on the surface of said bobbin between said ribs and said flange.

2. The bobbin of claim 1 wherein the ribs project from the body between 0.006 and 0.008 inch.

3. The bobbin of claim 2, wherein the ribs are spaced from said flange and each other 1.25 inch.

4. The bobbin of claim 1, wherein the grooves in the surface of the bobbin are cut to a depth of about between 0.001 and 0.005 inch.

5. The bobbin of claim 4, wherein the ribs are spaced from said flange and each other 1.25 inch.

6. The bobbin of claim 4, wherein the grooves are at a depth of 0.002 to 0.003 inch.

7. The bobbin of claim 1, wherein the ribs are spaced from the flange and each other at equal intervals.

8. The bobbin of claim 1, wherein said ribs are spaced from the flange and each other at equal intervals.

9. The bobbin of claim 8, wherein the ribs are spaced from the flange and each other 1.25 inch.

10. A bobbin having a body for the winding of yarn thereon, said body being defined by a bottom flange and a top, a plurality of ribs on said body being spaced at equal intervals on said body from the flange to at least the midpoint of said body but below said top, said ribs extending from the bobbin surface at least 0.006 inch, a plurality of equally spaced grooves in the surface of the body extending from the rib positioned furthest from the flange to the top, said grooves being at a depth of at least 0.001 inch, and a surface on said bobbin between the flange and each of said ribs which have a plurality of irregularly shaped ridges randomly distributed thereon.

11. The bobbin of claim 10, wherein the interval between the flange and the first rib and between each of the ribs is 1.25 inch.

12. The bobbin of claim 11, wherein the grooves are spaced one from the other at intervals of at least 0.001 inch.

13. The bobbin of claim 12, wherein the grooves are spaced one from the other at intervals of between 0.002 to 0.003 inch.

* * * * *